United States Patent [19]

Marker

[11] 4,276,848

[45] Jul. 7, 1981

[54] DEVICE FOR CONNECTING A SAILMAST TO A SAILBOARD

[76] Inventor: Hannes Marker, Hauptstrasse 51-53, 81 Garmisch-Partenkirchen, Fed. Rep. of Germany

[21] Appl. No.: 961,050

[22] Filed: Nov. 15, 1978

[30] Foreign Application Priority Data

Nov. 16, 1977 [DE] Fed. Rep. of Germany ..... 2751246

[51] Int. Cl.[3] ..... B63B 15/02

[52] U.S. Cl. ..... 114/91; 9/310 E

[58] Field of Search ..... 9/310 E, 310 D; 46/163; 114/39, 90, 91; 267/153, 175, 177; 403/220, 263, 253, 291

[56] References Cited

U.S. PATENT DOCUMENTS

| | | | |
|---|---|---|---|
| 2,761,244 | 9/1956 | Weih | 46/163 |
| 3,324,822 | 6/1967 | Carter | 9/310 E X |
| 3,588,074 | 6/1971 | Ochs | 267/177 X |
| 4,037,553 | 7/1977 | Marker | 9/310 E |
| 4,166,425 | 9/1979 | Kummetz | 9/310 E X |

*Primary Examiner*—Sherman D. Basinger
*Attorney, Agent, or Firm*—Fleit & Jacobson

[57] ABSTRACT

A device for connecting a sailmast to a sailboard comprises a mast-connecting universal joint, which is connected at one end to the mast and is permanently fixed thereto or can be only arbitrarily separated therefrom and is connected at its other end to a supporting member, which when the device is in position for use is received at least in part by a recess in the upper surface of the sailboard so as to be positively connected thereto. To provide for an overload coupling, the supporting member is constantly biased by a spring so that the positive connection can be eliminated only when the spring force is overcome.

3 Claims, 2 Drawing Figures

DEVICE FOR CONNECTING A SAILMAST TO A SAILBOARD

BACKGROUND OF THE INVENTION

1. Field of the Invention

This invention relates to a device for connecting a sailmast to a sailboard, comprising a mast-connecting universal joint, which is connected at one end to the mast and is permanently fixed thereto or can be only arbitrarily separated therefrom and which is connected at its other end to a supporting member, which when the device is in position for use is received at least in part by a recess in the upper surface of the sailboard so as to be positively connected thereto.

2. Description of the Prior Art

Various embodiments of such devices are known. In one embodiment, the supporting member comprises a pin, which extends into a vertical sleeve provided in the sailboard. One end of a cord is secured to the free end face of the pin. The other end of the cord is secured to the bottom of the sleeve. The cord is so long that is does not prevent a separation of the supporting member from the sailboard. In such case, the cord prevents a drifting of the floating sailboard away from the rig.

Compared to other known designs which also comprise a so-called retaining cord, that device has the advantage that the retaining cord is not disturbing during sailing and does not cause surprising and unintended falls of the sailor.

A disadvantage which is common to all embodiments resides in that the sailor cannot insert the supporting member into the recess of the sailboard quickly and in a simple manner and may be injured during the manipulation which is required. When the sailor is climbing on top of the sailboard in deep or surging water, the supporting member may often separate from the sailboard even when this is neither necessary nor intended.

SUMMARY OF THE INVENTION

It is an object of the invention to provide an improvement in this respect.

In a device of the kind defined first hereinbefore, this is accomplished in that the supporting member is constantly biased by a spring so that the positive connection can be eliminated only in that the spring force is overcome.

The spring force should be selected so that parts of the sailor's body cannot possibly be injured when such parts of the body are clamped between the falling-down mast and the sailboard, and that the supporting member is automatically retracted to its operative position after a safety release. As a result, the sailor need not enter the water only to re-connect the sailboard and the rig. If an unfavorable instantaneous relative position of the sailboard and rig prevents the automatic engagement of the clutch, it will be sufficient for the sailor slightly to swing or turn the sailboard in order to initiate the automatic retraction.

The spring consists suitably of a tension spring, which is accommodated by a duct, which extends as far as to the tip of the sailboard. The duct may open at the upper surface of the sailboard. A spring tightener is preferably arranged at the mouth of the duct. This enables a simple and fast installation and removal of the spring, e.g., for an exchange or renewal.

The spring may consist of a rubber spring. From the design aspect, it has proved desirable to connect the spring to the spring tightener by a flexible connecting element.

In order to enable a change of the initial stress of the spring within limits, the spring tightener may be adjustable in the longitudinal direction of the sailboard.

The supporting member is preferably non-circular and consists, e.g., of an inverted truncated pyramid.

BRIEF DESCRIPTION OF THE DRAWING

An illustrative embodiment of the invention will now be fully described with reference to the accompanying drawing, in which.

DESCRIPTION OF THE PREFERRED EMBODIMENTS

Figure 1:
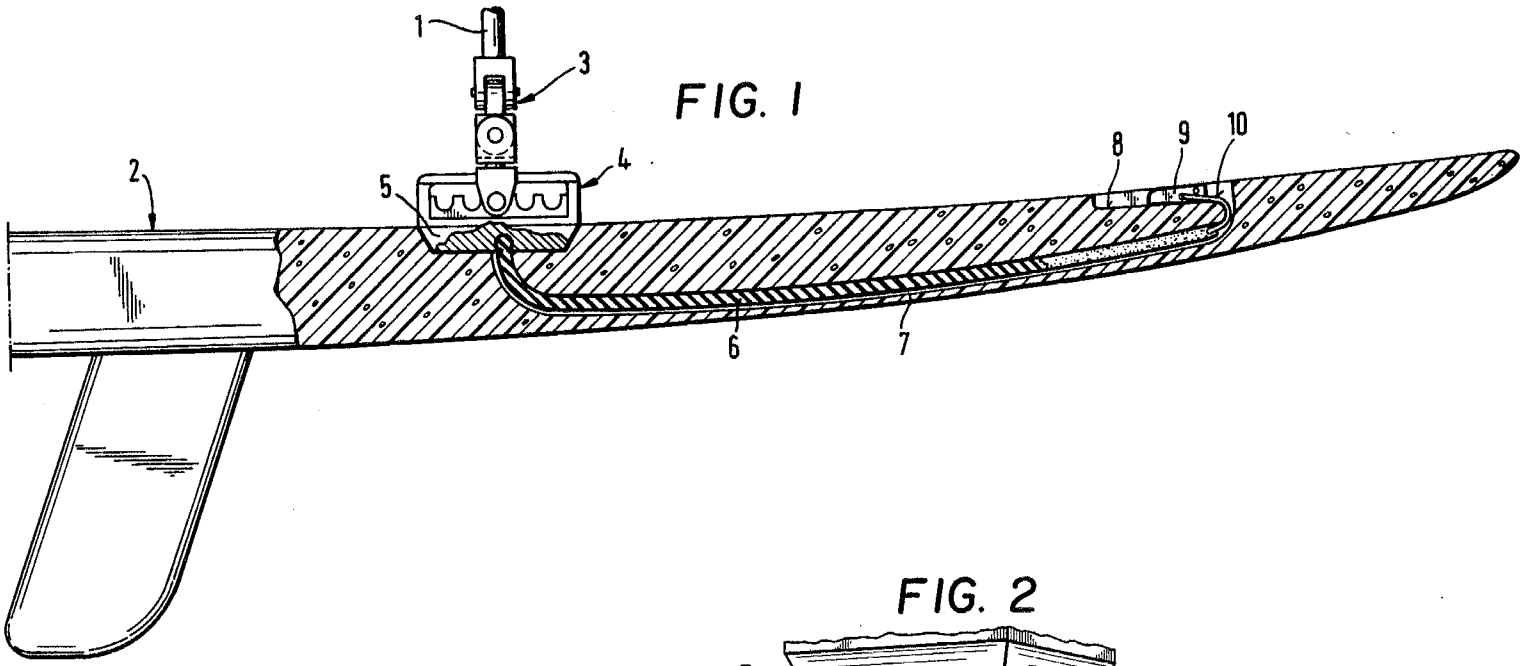
FIG. 1 shows in longitudinal section the bow of a sailboard provided with the device according to the invention and FIG. 2 shows an enlarged perspective of the base of the supporting member of the sailboard of FIG. 1.
Figure 2:
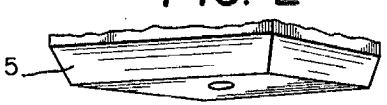

The figure illustrates a device that serves to connect a sailmast 1 to a sailboard 2, only the lower end portion of which is shown and is secured to a mast-connecting universal joint 3. The latter is known and for that reason is not shown in detail. By means of that universal joint and an interposed supporting member 4 the sailmast is supported on the sailboard 2. The supporting member consists, e.g., of a toothed bar, which is known from the applicant's German Patent Publication No. 24 49 636 and defines different points for the connection of the mast to the sailboard.

When the device is in the position for use which is shown, a portion 5 of the supporting member 4 interengages with a mating recess in the upper surface of the sailboard 2. That portion 5 has the shape of an inverted truncated pyramid and is connected to one end of a rubber spring 6, which is accommodated in a duct 7, which extends to the tip of the sailboard. The duct 7 opens at the upper surface of the sailboard in a recess 8, which accommodates a spring tightener 9. The rubber spring is connected to that spring tightener by a flexible connecting element 10. In the recess 8, the spring tightener is adjustable in the longitudinal direction of the sailboard 2 along a rail, which is not shown. The initial tension of the rubber spring 6 can be varied by that adjustment.

In addition to its positive connection to the sailboard 2, the supporting member 4 is non-positively connected by the rubber spring 6. Whereas in the previous designs the positive connection is ensured only in position of use, i.e., when the sailor holds the rig on the sailboard, the positive connection is now automatically restored when it has been eliminated. The positive connection is to be eliminated, e.g., when there are very strong forces tending to separate the sail from the sailboard and such forces overcome the force of the spring, which is capable of a considerable extension.

What is claimed is:

1. A device for connecting a sailmast to a sailboard, comprising a mast-connecting universal joint, which is connected at one end of the mast and which is connected at its other end to a supporting member, the supporting member when the device is in position for use being received at least in part by a first recess in the upper surface of the sailboard so as to be positively connected thereto, spring biasing means for constantly biasing the supporting member into contact with the sailboard so that the positive connection can be eliminated only when the force of the spring biasing means is overcome, the force when overcome tending to reestablish the positive connection between the supporting member and the sailboard, said sailboard having a second recess in its upper surface spaced from said first recess and a duct extending in the longitudinal direction of the sailboard interconnecting said recesses, said spring biasing means comprising a rubber spring positioned in said duct and having one end connected to said supporting member, a spring tightener adjustable in the longitudinal direction of the sailboard positioned in said second recess, and a flexible connecting element interconnecting said spring tightener with the other end of said rubber spring so that the force of said spring biasing means is adjusted by said spring tightener.

2. A device according to claim 1, characterized in that a spring tightener is arranged at the mouth of the duct.

3. A device according to claim 1, characterized in that the supporting member is non-circular and has the shape of an inverted truncated pyramid.

* * * * *